US007757409B2

(12) United States Patent
Snow et al.

(10) Patent No.: US 7,757,409 B2
(45) Date of Patent: Jul. 20, 2010

(54) CUSHIONING MEMBER

(75) Inventors: Rebecca E. Snow, Foxboro, MA (US); John Deem, Sharon, MA (US)

(73) Assignee: The Rockport Company, LLC, Canton, MA (US)

( * ) Notice: Subject to any disclaimer, the term of this patent is extended or adjusted under 35 U.S.C. 154(b) by 1028 days.

(21) Appl. No.: 11/380,543

(22) Filed: Apr. 27, 2006

(65) Prior Publication Data

US 2007/0251122 A1 Nov. 1, 2007

(51) Int. Cl.
*A43B 13/20* (2006.01)

(52) U.S. Cl. ..... 36/28; 36/29

(58) Field of Classification Search ..... 36/29, 36/28, 3 R, 3 B
See application file for complete search history.

(56) References Cited

U.S. PATENT DOCUMENTS

| | | | | |
|---|---|---|---|---|
| 3,893,247 | A | 7/1975 | Dana, III | |
| 3,946,505 | A | 3/1976 | Dana, III | |
| D249,748 | S | 10/1978 | Kitamura | |
| 4,183,156 | A | 1/1980 | Rudy | |
| D256,067 | S | 7/1980 | Hagg et al. | |
| 4,219,945 | A | 9/1980 | Rudy | |
| 4,235,026 | A | 11/1980 | Plagenhoef | |
| 4,271,606 | A | 6/1981 | Rudy | |
| D260,196 | S | 8/1981 | Plagenhoef | |
| D262,581 | S | 1/1982 | Chevallereau | |
| 4,340,626 | A | 7/1982 | Rudy | |
| 4,486,964 | A | 12/1984 | Rudy | |
| 4,506,460 | A | 3/1985 | Rudy | |
| D296,152 | S | 6/1988 | Selbiger | |
| D297,381 | S | 8/1988 | Sugiyama | |
| 4,817,304 | A * | 4/1989 | Parker et al. | 36/114 |
| D301,385 | S | 6/1989 | Weiner | |
| 4,906,502 | A | 3/1990 | Rudy | |
| D307,212 | S | 4/1990 | Aveni | |
| 4,936,029 | A | 6/1990 | Rudy | |
| D308,906 | S | 7/1990 | Kiyosawa | |
| D311,810 | S | 11/1990 | Hatfield | |
| D311,989 | S | 11/1990 | Parker et al. | |
| D312,918 | S | 12/1990 | Aveni | |
| D315,442 | S | 3/1991 | Kilgore et al. | |
| D316,324 | S | 4/1991 | Rogers | |
| D319,331 | S | 8/1991 | Hatfield et al. | |
| 5,042,176 | A | 8/1991 | Rudy | |
| D319,720 | S | 9/1991 | Selbiger | |
| D321,776 | S | 11/1991 | Hatfield | |

(Continued)

OTHER PUBLICATIONS

International Search Report dated Dec. 20, 2007, in International Application No. PCT/US07/09968.

*Primary Examiner*—Marie Patterson
(74) *Attorney, Agent, or Firm*—Sterne, Kessler, Goldstein & Fox P.L.L.C.

(57) ABSTRACT

A cushioning member for an article of footwear is disclosed. The article of footwear comprises a sole; and a cushioning member disposed in the sole, the cushioning member comprising: a substantially u-shaped heel chamber having an anterior wall, a curved posterior wall, and medial and lateral sidewalls disposed between the anterior wall and the posterior wall; a forefoot chamber; and a passage connecting the heel chamber and the forefoot chamber, wherein the sole is formed around the cushioning member such that at least a portion of the medial heel sidewall and the lateral heel sidewall are visible.

23 Claims, 12 Drawing Sheets

U.S. PATENT DOCUMENTS

| | | | | | |
|---|---|---|---|---|---|
| 5,083,361 | A | | 1/1992 | Rudy | |
| D323,927 | S | | 2/1992 | Rogers | |
| D324,131 | S | | 2/1992 | Lucas | |
| D325,288 | S | | 4/1992 | Richard et al. | |
| D326,766 | S | | 6/1992 | Kittle et al. | |
| 5,155,927 | A | | 10/1992 | Bates et al. | |
| D334,280 | S | | 3/1993 | Teague | |
| 5,195,256 | A | | 3/1993 | Kim | |
| D336,771 | S | | 6/1993 | Hatfield et al. | |
| D341,478 | S | | 11/1993 | Forland et al. | |
| D342,601 | S | | 12/1993 | Kilgore et al. | |
| 5,313,717 | A | * | 5/1994 | Allen et al. | 36/28 |
| D350,023 | S | | 8/1994 | Hatfield et al. | |
| 5,425,184 | A | * | 6/1995 | Lyden et al. | 36/29 |
| D363,372 | S | | 10/1995 | Hatfield et al. | |
| D366,756 | S | | 2/1996 | Forland et al. | |
| 5,493,792 | A | | 2/1996 | Bates et al. | |
| 5,543,194 | A | | 8/1996 | Rudy | |
| D375,619 | S | | 11/1996 | Backus et al. | |
| D376,902 | S | | 12/1996 | Avar | |
| 5,686,167 | A | | 11/1997 | Rudy | |
| 5,701,687 | A | * | 12/1997 | Schmidt et al. | 36/29 |
| 5,704,137 | A | * | 1/1998 | Dean et al. | 36/28 |
| D393,340 | S | | 4/1998 | Doxey | |
| 5,741,568 | A | | 4/1998 | Rudy | |
| 5,753,061 | A | | 5/1998 | Rudy | |
| D398,742 | S | | 9/1998 | Avar | |
| D410,964 | S | | 6/1999 | Wilborn et al. | |
| 5,916,664 | A | | 6/1999 | Rudy | |
| 5,930,918 | A | * | 8/1999 | Healy et al. | 36/29 |
| 5,956,869 | A | * | 9/1999 | Kim | 36/29 |
| 6,009,637 | A | * | 1/2000 | Pavone | 36/29 |
| 6,127,010 | A | | 10/2000 | Rudy | |
| 6,158,149 | A | | 12/2000 | Rudy | |
| 6,457,263 | B1 | * | 10/2002 | Rudy | 36/29 |
| 6,505,420 | B1 | * | 1/2003 | Litchfield et al. | 36/29 |
| 6,745,499 | B2 | * | 6/2004 | Christensen et al. | 36/29 |
| 6,782,641 | B2 | * | 8/2004 | Turner et al. | 36/29 |
| D499,878 | S | | 12/2004 | Rask | |
| D515,297 | S | | 2/2006 | Acheson | |
| 7,451,556 | B2 | * | 11/2008 | Harmon-Weiss et al. | 36/35 B |
| 2003/0101619 | A1 | * | 6/2003 | Litchfield et al. | 36/29 |
| 2003/0217484 | A1 | * | 11/2003 | Christensen et al. | 36/29 |
| 2004/0098882 | A1 | * | 5/2004 | Tuan | 36/29 |
| 2004/0237346 | A1 | * | 12/2004 | Rudy | 36/29 |
| 2007/0084082 | A1 | * | 4/2007 | Dojan et al. | 36/29 |

* cited by examiner

CUSHIONING MEMBER

BACKGROUND OF THE INVENTION

1. Field of the Invention

Embodiments of the present invention generally relate to a cushioning member, and more particularly relate to a cushioning member for use in an article of footwear.

2. Background Art

The human foot is a complex and remarkable piece of machinery, capable of withstanding and dissipating many impact forces. The natural padding of fat at the heel, as well as the collapsibility of the arch, help to cushion the foot. Throughout the course of an average day, the feet and legs of an individual are subjected to substantial impact forces. Running, jumping, walking, and even standing exert forces upon the feet and legs of an individual which can lead to soreness, fatigue, and injury.

Although the human foot possesses natural cushioning and rebounding characteristics, the foot may need extra support to overcome many of the forces encountered during extended periods of activity. Unless an individual is wearing shoes which provide proper cushioning and support, the soreness and fatigue resulting from even low levels of activity on unnatural surfaces is acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

In light of these problems, numerous attempts have been made to incorporate improved cushioning and resiliency into a shoe. For example, a concept practiced in the footwear industry to improve cushioning and energy return has been the use of fluid-filled systems within shoe soles. These devices attempt to enhance cushioning and energy return by transferring a pressurized fluid between the heel and forefoot areas of a shoe. In addition, the design of the cushioning member may be an important marketing consideration.

Various embodiments of the present invention may provide improved cushioning to the wearer of an article of footwear. Some, but not necessarily all, embodiments of the present invention may provide a design, appearance, and/or visibility of the cushioning member so as to improve functionality and marketing considerations for the shoe incorporating the cushioning member. Additional advantages of embodiments of the present invention are set forth, in part, in the description which follows and, in part will be apparent to one of ordinary skill in the art from the description and/or from the practice of the invention.

BRIEF SUMMARY OF THE INVENTION

Applicant has developed an innovative article of footwear. In one embodiment, the article of footwear comprises: a sole; and a cushioning member disposed in the sole, the cushioning member comprising: a substantially symmetrical u-shaped heel chamber having an anterior wall, a posterior wall, and medial and lateral sidewalls disposed between the anterior wall and the posterior wall; a forefoot chamber; and a passage connecting the heel chamber and the forefoot chamber, wherein the sole is formed around the cushioning member such that at least a portion of the medial heel sidewall and the lateral heel sidewall are visible.

Applicant has further developed an innovative cushioning member disposed in article of footwear having a sole. In one embodiment, the cushioning member comprises: a heel chamber having an anterior wall, a curved posterior wall, and medial and lateral sidewalls disposed between the anterior wall and the posterior wall; a forefoot chamber having an anterior wall, a posterior wall, and medial and lateral sidewalls disposed between the forefoot anterior wall and the forefoot posterior wall; and a passage connecting the heel chamber and the forefoot chamber, wherein the sole is formed around the cushioning member such that at least a portion of the medial heel sidewall and the lateral heel sidewall are visible and at least a portion of the forefoot chamber is visible.

Applicant has further developed a fluid-filled cushioning member disposed in an article of footwear having a sole, the cushioning member comprising: a substantially symmetrical u-shaped heel chamber having an anterior wall, a posterior wall, and medial and lateral sidewalls disposed between the anterior wall and the posterior wall; a forefoot chamber having an anterior wall, a posterior wall, and medial and lateral sidewalls disposed between the forefoot anterior wall and the forefoot posterior wall; and a passage connecting the heel chamber and the forefoot chamber, the passage comprising first and second air ports in communication with the forefoot chamber, and a depression formed between said first and second air ports, wherein the sole is formed around the cushioning member such that at least a portion of the heel chamber is visible and at least a portion of the forefoot chamber is visible.

It is to be understood that both the foregoing general description and the following detailed description are exemplary and explanatory only, and are not restrictive of the invention as claimed.

BRIEF DESCRIPTION OF THE DRAWINGS/FIGURES

DETAILED DESCRIPTION OF THE INVENTION

Figure 1:
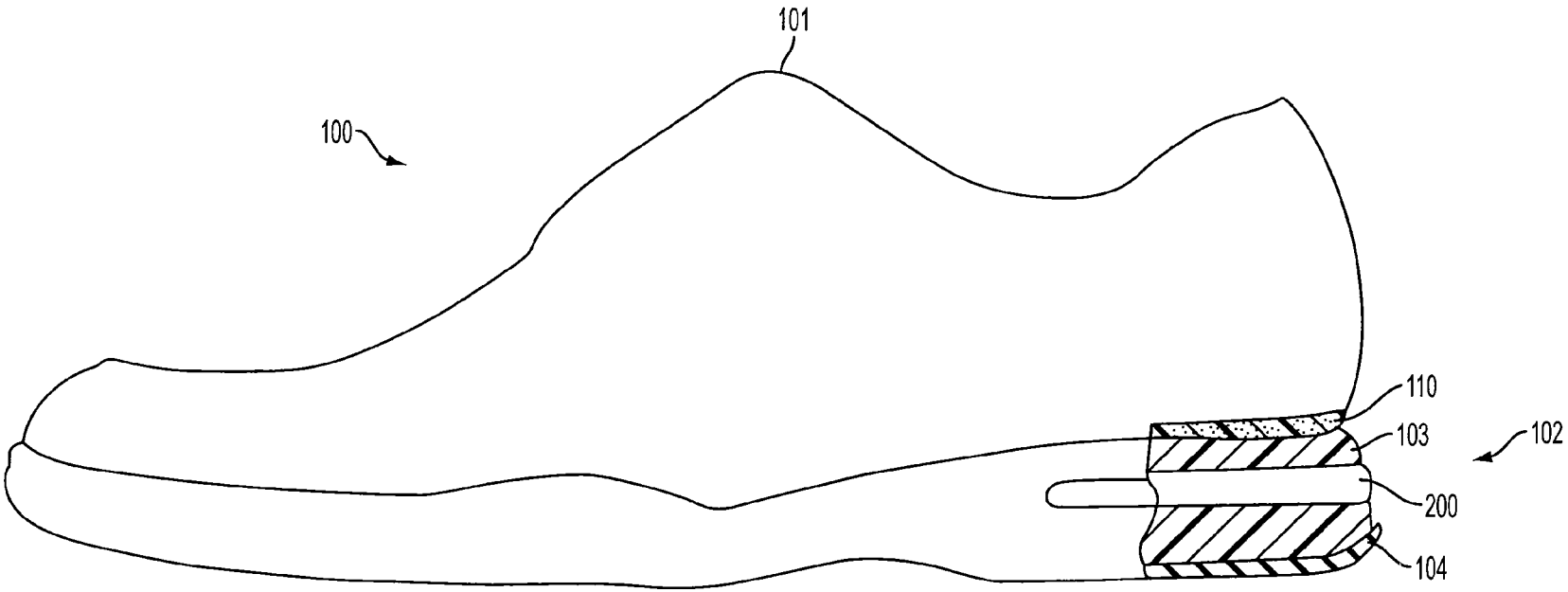
FIG. 1 is a lengthwise partial cross-sectional view of a shoe having a cushioning member according to an embodiment of the present invention.

Reference will now be made in detail to embodiments of the present invention with reference to the accompanying figures, in which like reference numerals indicate like elements.

Referring now to FIG. 1, an article of footwear, such as, for example, a shoe 100 according to an embodiment of the present invention is shown in partial cross-section, the section taken of a portion of the heel of the shoe lengthwise at the center of the shoe 100. The shoe 100 includes a lateral side (outside of the foot) and a medial side (inside of the foot, shown in FIG. 1). A right foot shoe is shown, however, it will be apparent to one of ordinary skill in the art that a left foot shoe comprises a mirror image thereof.

As shown in FIG. 1, the shoe 100 generally includes a shoe upper 101, a sole 102, and a footbed 110. A cushioning member 200 is disposed in the sole 102. The cushioning member 200 may provide cushioning to a wearer of the shoe 100 such that the wearer's stride forces air within the cushioning member 200 to move in a complementary manner with respect to the stride.

It will be appreciated that the shoe upper 101 may comprise any material or design known to one of ordinary skill in the art. Common materials used for the shoe upper 101 include leather, woven materials such as, for example, canvas, and synthetic materials such as, for example, vinyl.

In one embodiment, the sole 102 may comprise a midsole 103 and an outsole 104. The outsole 104 is preferably constructed of a resilient, durable material such as, for example, rubber. The outsole 104 is intended to provide traction as the ground-engaging surface of the shoe 100. In the embodiment of the present invention shown in FIG. 1, the outsole 104 covers the entire lower-most surface of the sole 102. It will be apparent to one of ordinary skill in the art that the outsole 104 may cover only one or more portions of the sole 102, or could be eliminated entirely.

The midsole 103 provides structure to the sole 102, as well as additional padding between a wearer's foot and the ground. The midsole 103 may be constructed of a material that is less dense than that used for the outsole 104, so that the thickness of the sole 102 may be increased without significantly increasing the weight of the shoe 100. In a preferred embodiment of the present invention, the midsole 103 comprises ethyl vinyl acetate (EVA). Other materials appropriate for the midsole 103 including, but not limited to, polyurethane (PU), thermoplastic urethane (TPU), and thermoplastic rubber (TPR) are considered to be within the scope of the present invention.

Figure 2:
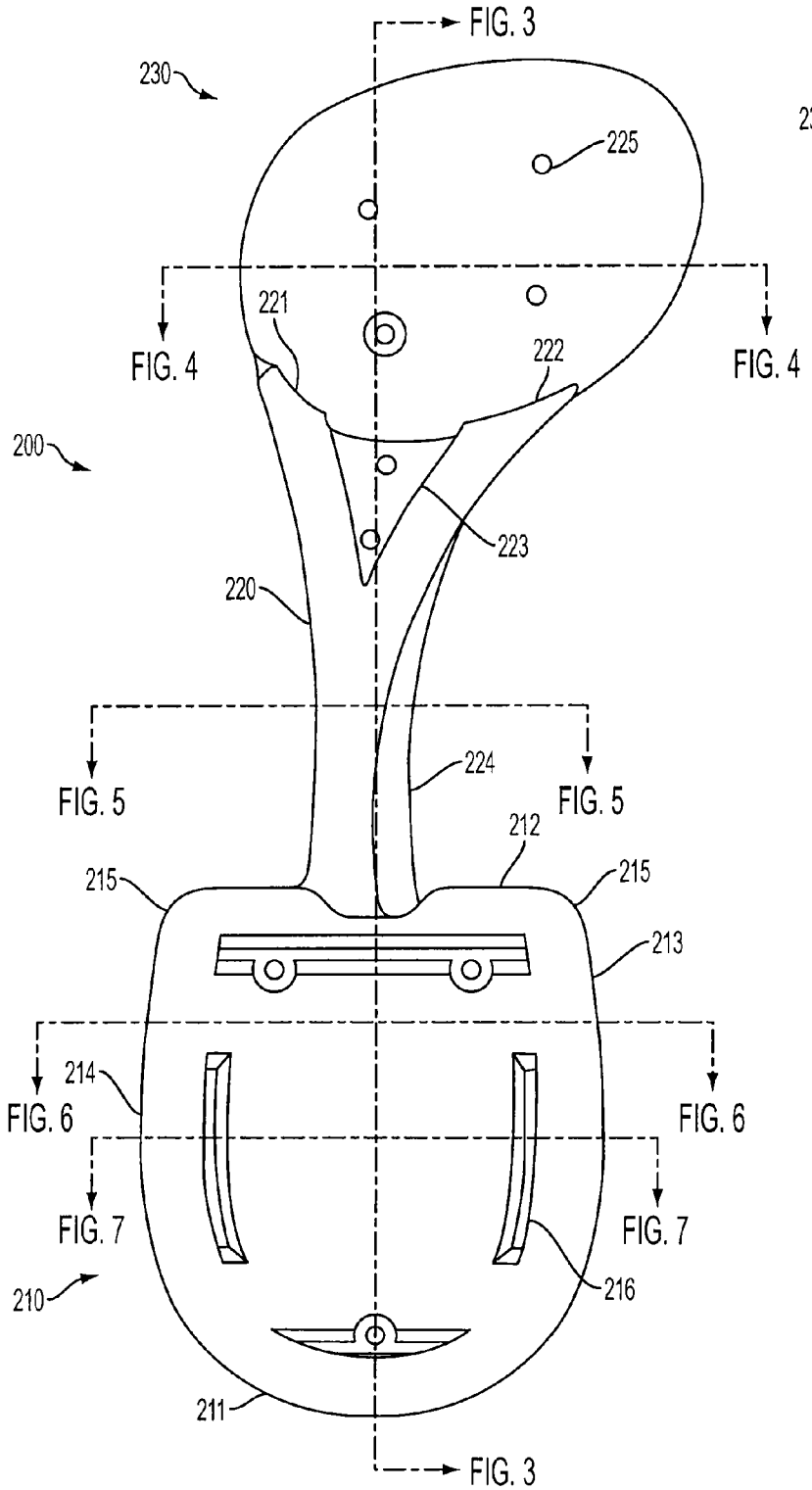
FIG. 2 is a bottom view of a cushioning member according to a first embodiment of the present invention.

A first embodiment of the cushioning member 200 is shown with reference to FIGS. 2-12. FIG. 2 is a bottom view of the cushioning member 200 according to a first embodiment of the present invention. Because the top and bottom of the cushioning member are substantially mirror images of one another, it is appreciated that the top view of the cushioning member 200 is substantially the same as the bottom view. In addition, embodiments of the cushioning member 200 of the present invention may readily be incorporated within either a left or a right shoe. It will be appreciated that the symmetrical structure of the cushioning member 200 may increase the ease and reduce the expense of manufacturing the cushioning member 200.

The cushioning member 200 is preferably a single member having three discrete components. As shown with reference to FIG. 2, the cushioning member includes a heel chamber 210 in communication with a forefoot chamber 230 through a fluid passage 220. The heel chamber 210 is disposed beneath the heel of a wearer when the cushioning member 200 is incorporated with the shoe 100. The heel chamber 210 includes a curved posterior wall 211, and an anterior wall 212. A medial sidewall 213, and a lateral sidewall 214 are disposed between the posterior wall 211 and the anterior wall 212. The posterior wall 211, the medial sidewall 213, and the lateral sidewall 214 are provided such that the heel chamber 210 may generally comprise a symmetrical u-shaped chamber that conforms to the outline of the heel portion of the sole 102. The medial heel sidewall 213 and the lateral heel sidewall 214 may intersect the heel front wall 212 at curved edges 215. The curved edges 215 of the heel chamber 210 may comprise a large radius of curvature, which may be strong and flexible as compared with a sharp edge or an edge having a smaller radius of curvature.

The forefoot chamber 230 is disposed opposite the heel chamber 210 and beneath a portion of the forefoot or metatarsal area of a wearer when incorporated within the shoe 100. In the embodiment shown in FIG. 2, the forefoot chamber 230 comprises a generally oval shaped chamber.

The cushioning member 200 is a hollow structure preferably filled with a fluid. In one embodiment of the present invention, the fluid may comprise a pressurized gas. In one embodiment of the present invention, the cushioning member 200 is filled with Nitrogen ($N_2$). Nitrogen gas may provide a clean, readily available, and/or stable gas that may be less susceptible to pressure and/or temperature drops. Other gases, including, but not limited to, sulfur hexafluoride (SF6) may be suitable for use within the cushioning member 200 without departing from the scope and spirit of the claimed invention. The cushioning member 200 may be impermeable to air such that it is not possible for the gas disposed inside the cushioning member 200 to escape upon application of force to the cushioning member 200. It is appreciated, however, that gas may diffuse in and out of the cushioning member 200 under normal operating conditions. The cushioning member 200 may retain its cushioning properties throughout the life of the article of footwear in which it is incorporated. In an alternative embodiment of the present invention, the fluid may comprise ambient air.

The fluid passage 220 provides fluid communication between the heel chamber 210 and the forefoot chamber 230. In one embodiment, as shown in FIG. 2, the fluid passage 220 includes first 221 and second 222 fluid ports in communication with the forefoot chamber 230, permitting fluid flow into and out of the forefoot chamber 230. The first 221 and second 222 fluid ports may be formed such that the fluid passage 220 comprises a forked passage that separates the flow of fluid as it enters and exits the forefoot chamber 230. Separation of the fluid flow reduces the mass of fluid flowing through any one particular point of the cushioning member, and, thus, may reduce the noise created by the fluid flow in the shoe 100 during operation.

Figure 10:
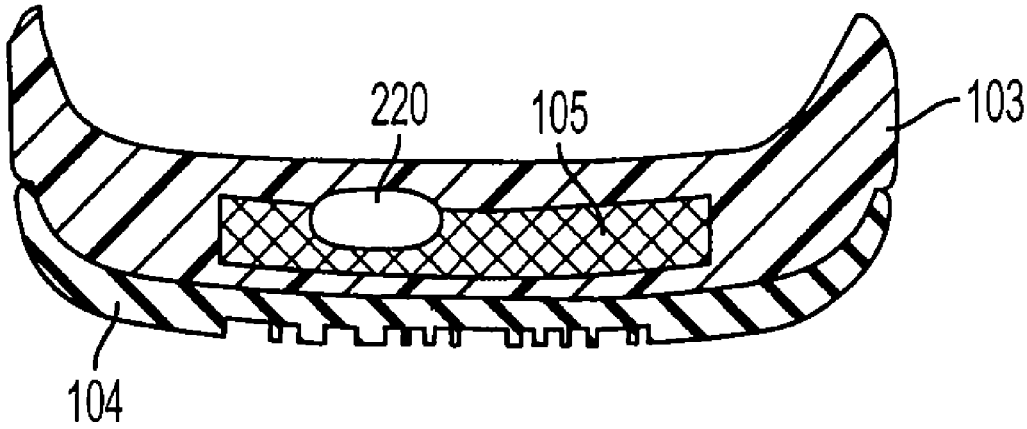
FIG. 10 is a cross-sectional view of a shoe having a cushioning member according to a first embodiment of the present invention, taken along line 10-10 of FIG. 8.
Figure 11:
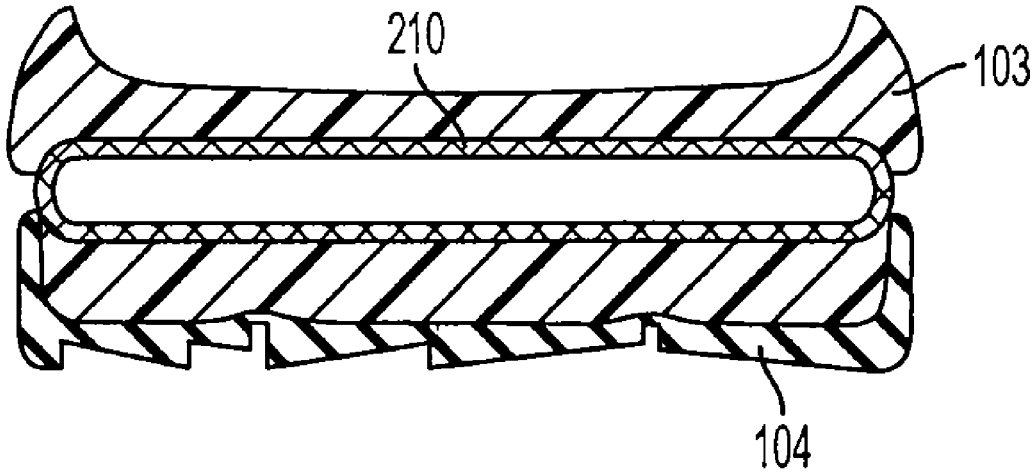
FIG. 11 is a cross-sectional view of a shoe having a cushioning member according to a first embodiment of the present invention, taken along line 11-11 of FIG. 8.

With reference to FIG. 10, in one embodiment of the present invention, the fluid passage 220 may be disposed in a midfoot region 105 of the midsole 103. The midfoot region 105 may comprise a shank member 105, and the fluid passage 220 may be disposed in a cavity formed in the shank member. In one embodiment, the shank member 105 may comprise a material, such as, for example, TPU, that may be harder and less flexible than the material of the midsole 103. As such, the shank member 105 may provide additional support to the middle portion of the sole 102.

A depression 223 may be formed in the cushioning member 200 between the first 221 and second 222 fluid ports of the fluid passage 220. The depression 223 may be formed such that no fluid flows through or is stored within the depression 223. When the cushioning member 200 is provided in the shoe 100, the depression 223 is preferably located beneath the metatarsal arch of the wearer. The metatarsal arch can be a sensitive area of the foot, and the sensation caused by the flow of fluid beneath this area can provide discomfort to the wearer. Because there is no fluid flow within the depression 223, the depression 223 may provide improved comfort to the wearer. The depression 223 may also provide a convenient portion of the cushioning member 200 to present data relating to the cushioning member, such as, for example, manufacturing information, and patent marking.

With reference to FIGS. 8-12, the cushioning member 200 is disposed in the midsole 103 such that the midsole is formed around the cushioning member 200. As will be apparent to those of ordinary skill in the art, the material of the midsole 103, such as, for example, polyurethane, may be poured around the cushioning member 200 and cooled such that the cushioning member 200 adheres to the midsole 103. The cushioning member 200 may include a tab 224 formed along a longitudinal edge of the fluid passage 220, as best shown in FIG. 2. The tab 224 may provide stability of the cushioning member 200 during manufacturing, and may prevent the cushioning member from twisting during cooling. In one embodiment, the cushioning member 200 may be further attached to the midsole 103 with adhesive material such as cement or the like.

In an alternative embodiment of the present invention, the cushioning member 200 may be disposed in a cavity formed in the midsole 103. The cavity may be formed on the top of the midsole 103, or between the bottom of the midsole and the outsole 104. The cushioning member 200 may be attached to the midsole 103 with adhesive material such as cement or the like. In another embodiment of the present invention, an upper midsole portion comprising a material different from the rest of the midsole 103, such as, for example, polyurethane wherein the rest of the midsole 103 may comprise EVA, may first be molded directly to all or a portion of the cushioning member 200. The upper midsole portion and the cushioning member 200 may then be cemented into a cavity formed in the midsole 103.

Figure 12:
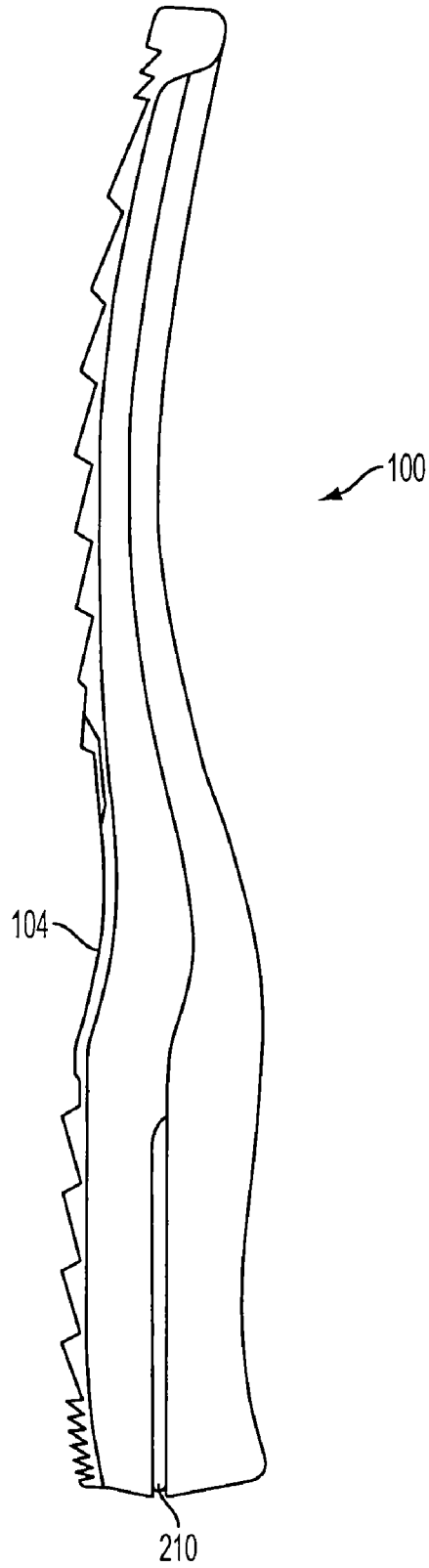
FIG. 12 is a side view of a portion of a shoe having a cushioning member according to a first embodiment of the present invention.
Figure 13:
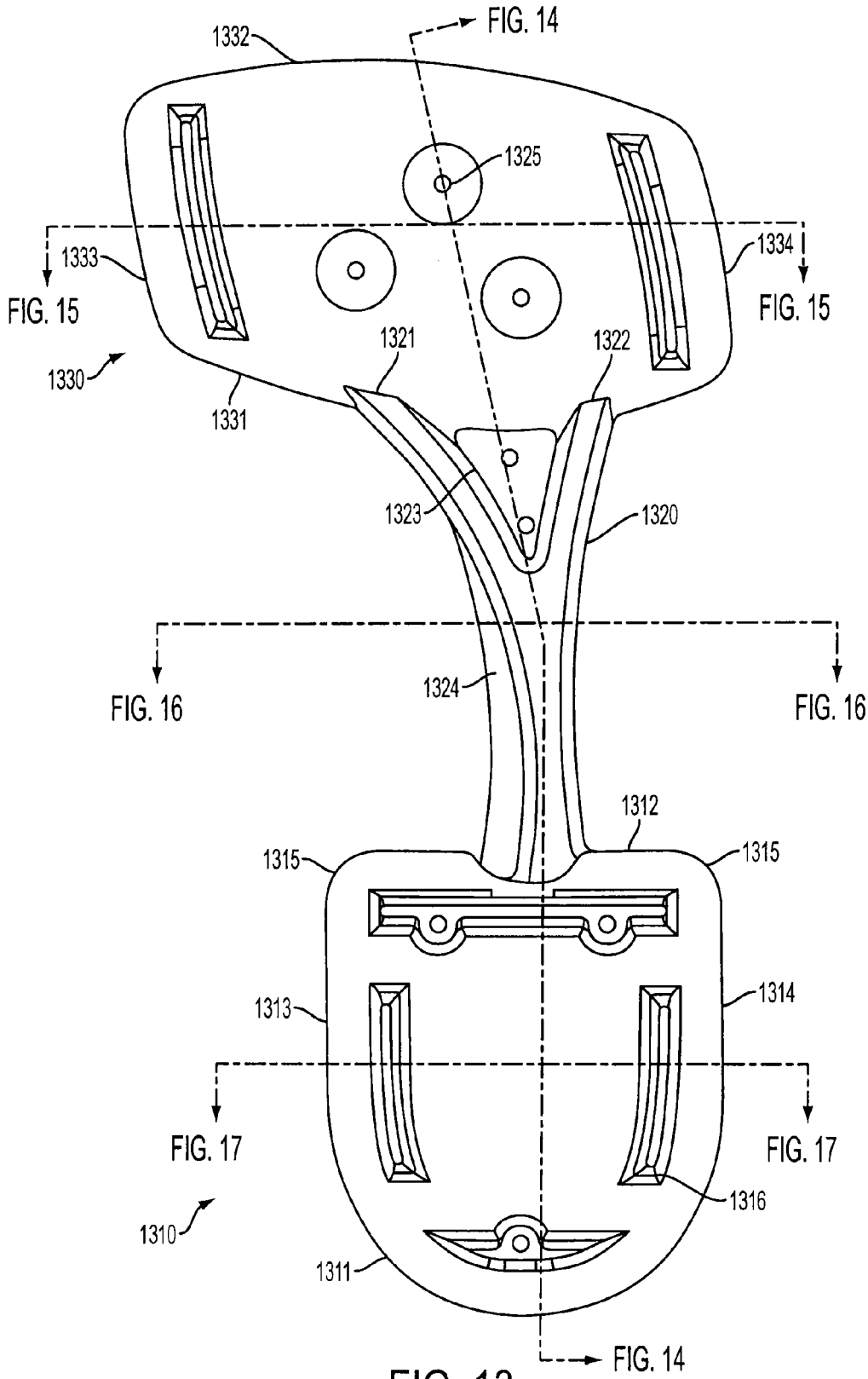
FIG. 13 is a top view of a cushioning member according to a second embodiment of the present invention.
Figure 14:
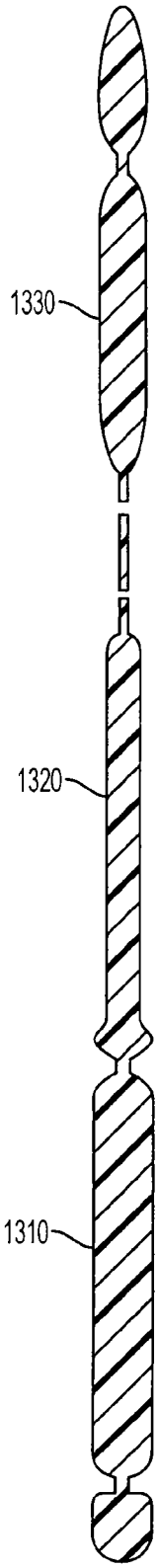
FIG. 14 is a cross-sectional view of a cushioning member according to a second embodiment of the present invention, taken along line 14-14 of FIG. 13.
Figure 15:
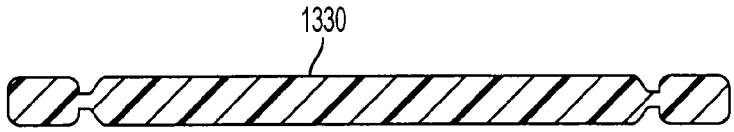
FIG. 15 is a cross-sectional view of a cushioning member according to a second embodiment of the present invention, taken along line 15-15 of FIG. 13.
Figure 16:
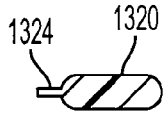
FIG. 16 is a cross-sectional view of a cushioning member according to a second embodiment of the present invention, taken along line 16-16 of FIG. 13.
Figure 17:
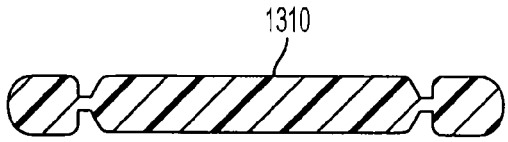
FIG. 17 is a cross-sectional view of a cushioning member according to a second embodiment of the present invention, taken along line 17-17 of FIG. 13.
Figure 18:
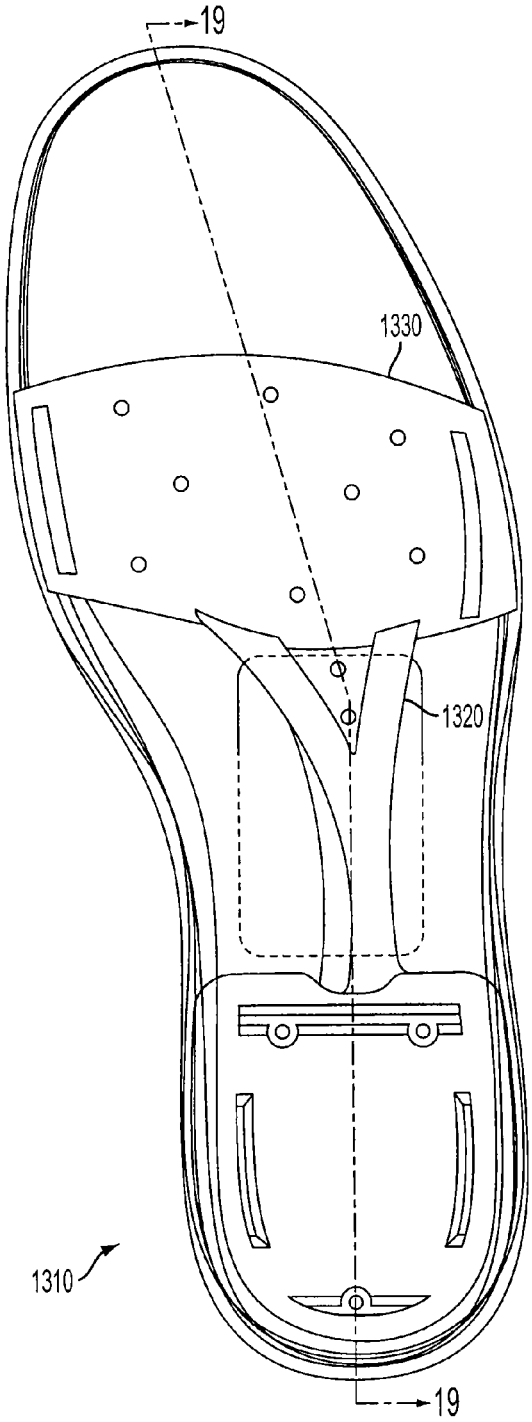
FIG. 18 is a top view of a shoe having a cushioning member according to a second embodiment of the present invention disposed therein.
Figure 19:
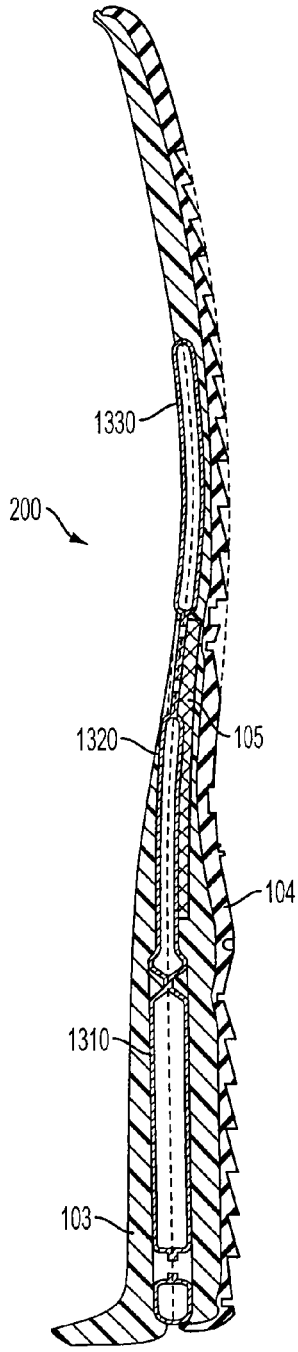
FIG. 19 is a cross-sectional view of a shoe having a cushioning member according to a second embodiment of the present invention, taken along line 19-19 of FIG. 18.

In various embodiments of the present invention, the visibility of the cushioning member 200 may be of particular importance to the design of the shoe 100. The sole 102 may be formed around the cushioning member 200 such that at least a portion of the heel chamber 210 of the cushioning member 200 is visible. With reference to FIG. 12, in one embodiment, at least a portion of the medial heel sidewall 213, at least a portion of the lateral heel sidewall 214, and at least a portion of the posterior wall 211 are visible. It is contemplated that in other embodiments of the present invention, all of or a portion of one or more of the medial heel sidewall 213, the lateral heel sidewall 214, and the posterior wall 211 may be visible.

Figure 8:
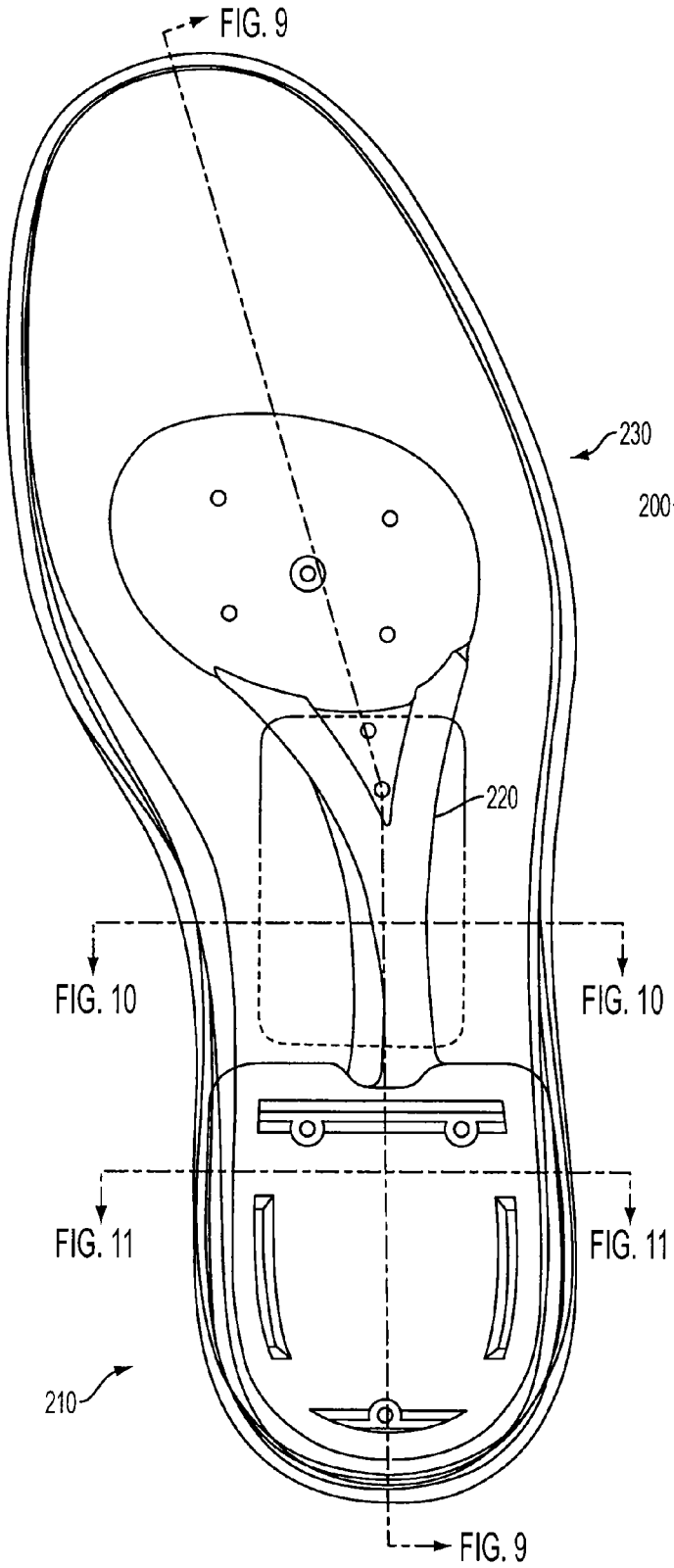
FIG. 8 is a top view of a sole having a cushioning member according to a first embodiment of the present invention disposed therein.

With reference to FIGS. 2 and 8, the cushioning member 200 may further comprise means for controlling the flow of fluid within the cushioning member. In one embodiment, the cushioning member 200 may include one or more weld lines 216 formed in the heel chamber 210, and one or more spot welds 225 formed in the forefoot chamber 230. The weld lines 216 and the spot welds 225 may be positioned such that the heel chamber 210 and/or the forefoot chamber 230 of the cushioning member 200 do not over expand with fluid or balloon during operation. For example, a plurality of weld lines 216 may be formed around the perimeter of the heel chamber 210 and may prevent the flow of fluid into the heel chamber from causing the heel chamber 210 to over expand. In addition, a plurality of spot welds 225 may be formed in a quadrilateral arrangement in the center of the forefoot chamber 230 and may prevent the flow of fluid into the forefoot chamber from causing the forefoot chamber 230 to over expand. Over expansion of the chambers of the cushioning member 200 may cause discomfort to the wearer, and may also cause the cushioning member 200 to separate from the sole 103 of the shoe 100. The precise number, size, shape, and location of the spot welds 225 and the weld lines 216 shown is intended to be exemplary only. It is contemplated that other configurations of the weld lines 216 and the spot welds 225 may be provided without departing from the scope of the present invention.

Figure 3:
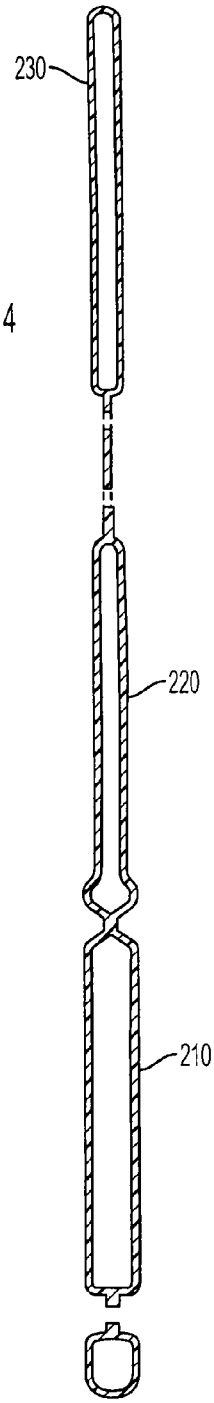
FIG. 3 is a cross-sectional view of a cushioning member according to a first embodiment of the present invention, taken along line 3-3 of FIG. 2.
Figure 4:
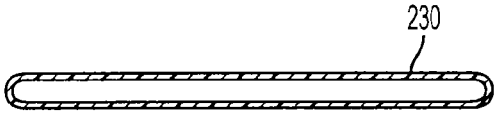
FIG. 4 is a cross-sectional view of a forefoot chamber of a cushioning member according to a first embodiment of the present invention, taken along line 4-4 of FIG. 2.
Figure 5:
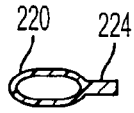
FIG. 5 is a cross-sectional view of a fluid passage of a cushioning member according to a first embodiment of the present invention, taken along line 5-5 of FIG. 2.
Figure 6:
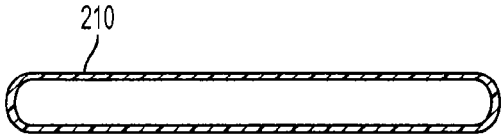
FIG. 6 is a cross-sectional view of a heel chamber of a cushioning member according to a first embodiment of the present invention, taken along line 6-6 of FIG. 2.
Figure 7:
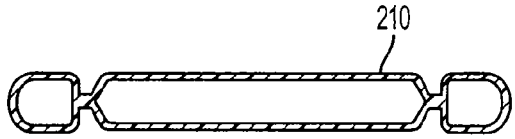
FIG. 7 is a cross-sectional view of the heel chamber of a cushioning member according to a first embodiment of the present invention, taken along line 7-7 of FIG. 2.
Figure 9:
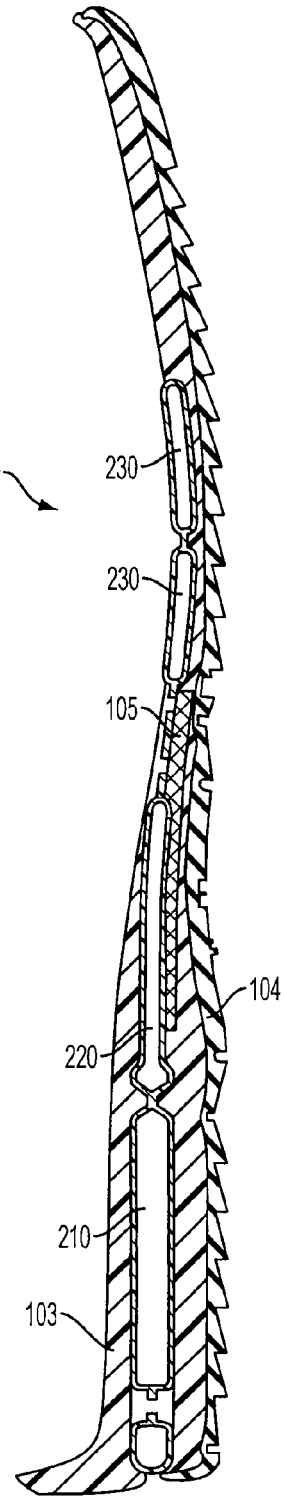
FIG. 9 is a cross-sectional view of a shoe having a cushioning member according to a first embodiment of the present invention, taken along line 9-9 of FIG. 8.

With reference to FIGS. 3 and 9, the cushioning member 200 may be provided such that the height profile of the heel chamber 210 is greater than the height profile of the forefoot chamber 230. In one embodiment, the height profile of the heel chamber 210 is greater than the height profile of the forefoot chamber 230 by a ratio of approximately 2 to 1. As a result, when in an unloaded condition, the volume of fluid within the heel chamber 210 is greater than the volume of fluid within the forefoot chamber 230 by approximately the same ratio. This ratio may provide improved comfort to the wearer as the heel portion of the foot may encounter greater impact forces, for example, during running, and, thus, may require more cushioning than the forefoot portion. In addition, the reduced height profile as the cushioning member 200 moves forward in the shoe may allow for the member to fit in a wider variety of shoes.

The cushioning member 200 is preferably formed via extrusion blow molding. As will be apparent to those of ordinary skill in the art, the cushioning member 200 may be formed during the blow molding process such that a unitary member is formed and each of the three discrete components described herein is formed using the same mold. The cushioning member 200 is preferably formed of a suitably resilient material so as to allow the cushioning member 200 to compress and expand while also resisting breakdown. In one embodiment, the cushioning member 200 may comprise a highly crystalline Thermoplastic Urethane (TPU). Other materials, including, but not limited to, EVA, thermoplastics, and/or other suitably resilient materials may be used without departing from the scope and spirit of the present invention.

Operation of the first embodiment of the present invention will now be described. When stationary, the foot of the wearer is adequately cushioned by the cushioning member 200, and substantially no air flows through the fluid passage 220 from the heel chamber 210 to the forefoot chamber 230. During a typical gait cycle, the main distribution of forces on the foot begins adjacent the lateral side of the heel during the "heel strike" phase of the gait. At this point, the heel area of the shoe 100 contacts the ground or other support surface first, and the weight of the wearer applies downward pressure on the heel chamber 210, causing the chamber to compress. The compression of the heel chamber 210 causes fluid in the chamber to be forced forwardly, through the fluid passage 220 and the first 221 and second 222 fluid ports to the forefoot chamber 230. The flow of fluid into the forefoot chamber 230 causes the forefoot chamber to expand.

As the gait cycle continues, the distribution of forces on the foot moves toward the center axis of the foot in the arch area at mid-stride, rolls medially and then shifts to the center axis of the foot again during "toe-off." When the forefoot of the wearer contacts the ground, the expanded forefoot chamber 230 provides cushioning from the related impact forces. As the weight of the wearer is applied to the forefoot, the downward pressure caused by the impact forces causes the forefoot chamber 230 to compress, forcing the air therein to be thrust rearwardly through the fluid passage 220 into the heel chamber 210. It is noted that the weld lines 216 prevent over expansion of the heel chamber 210 which could cause discomfort to the wearer. After "toe-off," no downward pressure is applied to the cushioning member 200, so the air within the member returns to its unloaded state. The gait cycle is then repeated. In this manner, the cushioning member 200 may provide cushioning to a wearer of the shoe 100 such that the wearer's stride forces air within the cushioning member 200 to move in a complementary manner with respect to the stride.

A second embodiment of the cushioning member 200 of the present invention is shown in FIGS. 13-20, in which like reference numerals refer to like elements. The cushioning member 200 includes a heel chamber 1310 in communication with a forefoot chamber 1330 through a fluid passage 1320. The heel chamber 1310 is disposed beneath the heel of a wearer when the cushioning member 200 is incorporated within the shoe 100. The heel chamber 1310 includes a curved posterior wall 1311, and an anterior wall 1312. A medial sidewall 1313, and a lateral sidewall 1314 are disposed between the posterior wall 1311 and the anterior wall 1312. The posterior wall 1311, the medial sidewall 1313, and the lateral sidewall 1314 are provided such that the heel chamber 1310 may generally comprise a symmetrical u-shaped chamber that conforms to the outline of the heel portion of the sole 102.

The forefoot chamber 1330 is disposed opposite the heel chamber 1310 and beneath a portion of the forefoot or metatarsal area of a wearer when incorporated within the shoe 100. The forefoot chamber 1330 includes a posterior wall 1331, and an anterior wall 1332. A medial sidewall 1333, and a lateral sidewall 1334 are disposed between the posterior wall 1331 and the anterior wall 1332.

The cushioning member 200 may further comprise means for controlling the flow of fluid within the cushioning member. In one embodiment, the cushioning member 200 may include one or more weld lines 1316 formed in the heel chamber 1310 and the forefoot chamber 1330, and one or more spot welds 1325 formed in the forefoot chamber 1330. The weld lines 1316 and the spot welds 1325 may be positioned such that the heel chamber 1310 and/or the forefoot chamber 1330 of the cushioning member 200 do not over expand with fluid or balloon during operation. For example, in one embodiment a plurality of weld lines 1316 may be formed around the perimeter of the heel chamber 1310 and may prevent the flow of fluid into the heel chamber from causing the heel chamber 1310 to over expand. In one embodiment, weld lines also may be formed in the medial and lateral side of the forefoot chamber 1330. In addition, a plurality of spot welds 1325 may be formed in a triangular arrangement in the center of the forefoot chamber 1330 and may prevent the flow of fluid into the forefoot chamber from causing the forefoot chamber 1330 to over expand. The precise number, size, shape, and location of the spot welds 1325 and the weld lines 1316 shown is intended to be exemplary only. It is contemplated that other configurations of the weld lines 1316 and the spot welds 1325 may be provided without departing from the scope of the present invention.

Figure 20:
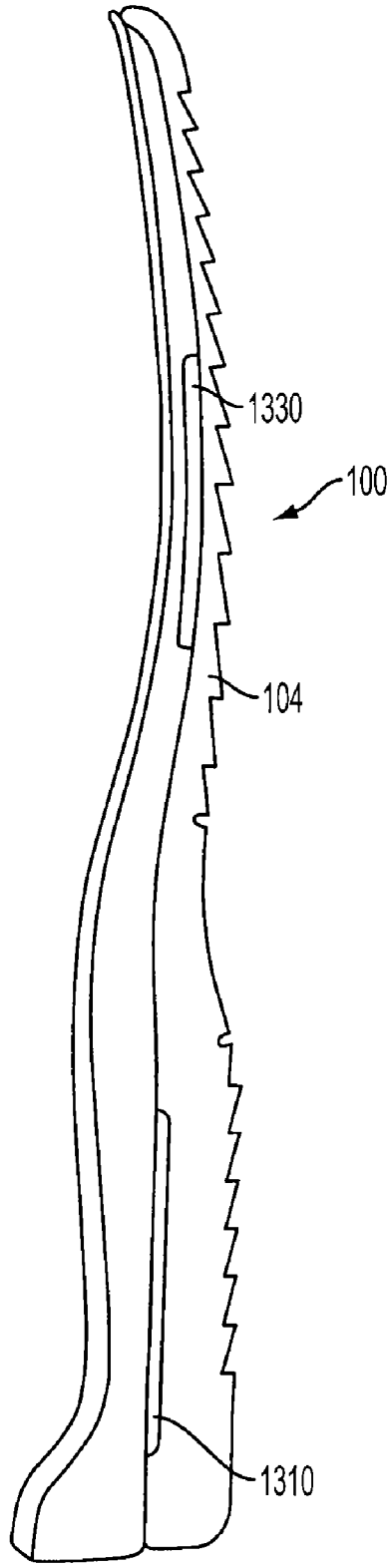
FIG. 20 is a side view of a portion of a shoe having a cushioning member according to a second embodiment of the present invention.

The sole 102 may be formed around the cushioning member 200 such that at least a portion of the forefoot chamber 1330 of the cushioning member 200 is visible. With reference to FIG. 20, in one embodiment, at least a portion of the medial forefoot sidewall 1333 and at least a portion of the lateral forefoot sidewall 1334 may be visible. In another embodiment, the anterior wall 1332 of the forefoot chamber 1330 may conform to the outline of the toe portion of the shoe 100 such that the medial forefoot sidewall 1313, the lateral heel sidewall 1314, and the anterior wall 1332 are visible. It is contemplated that in other embodiments of the present invention, all of or a portion of one or more of the medial forefoot sidewall 1313, the lateral heel sidewall 1314, and the anterior wall 1332 may be visible. It is further contemplated that in some embodiments all or a portion of the forefoot chamber 1330 may be visible without the heel chamber 1310 being visible, and in some other embodiments, all or a portion of both the forefoot chamber 1330 and the heel chamber 1330 may be visible.

Figure 21:
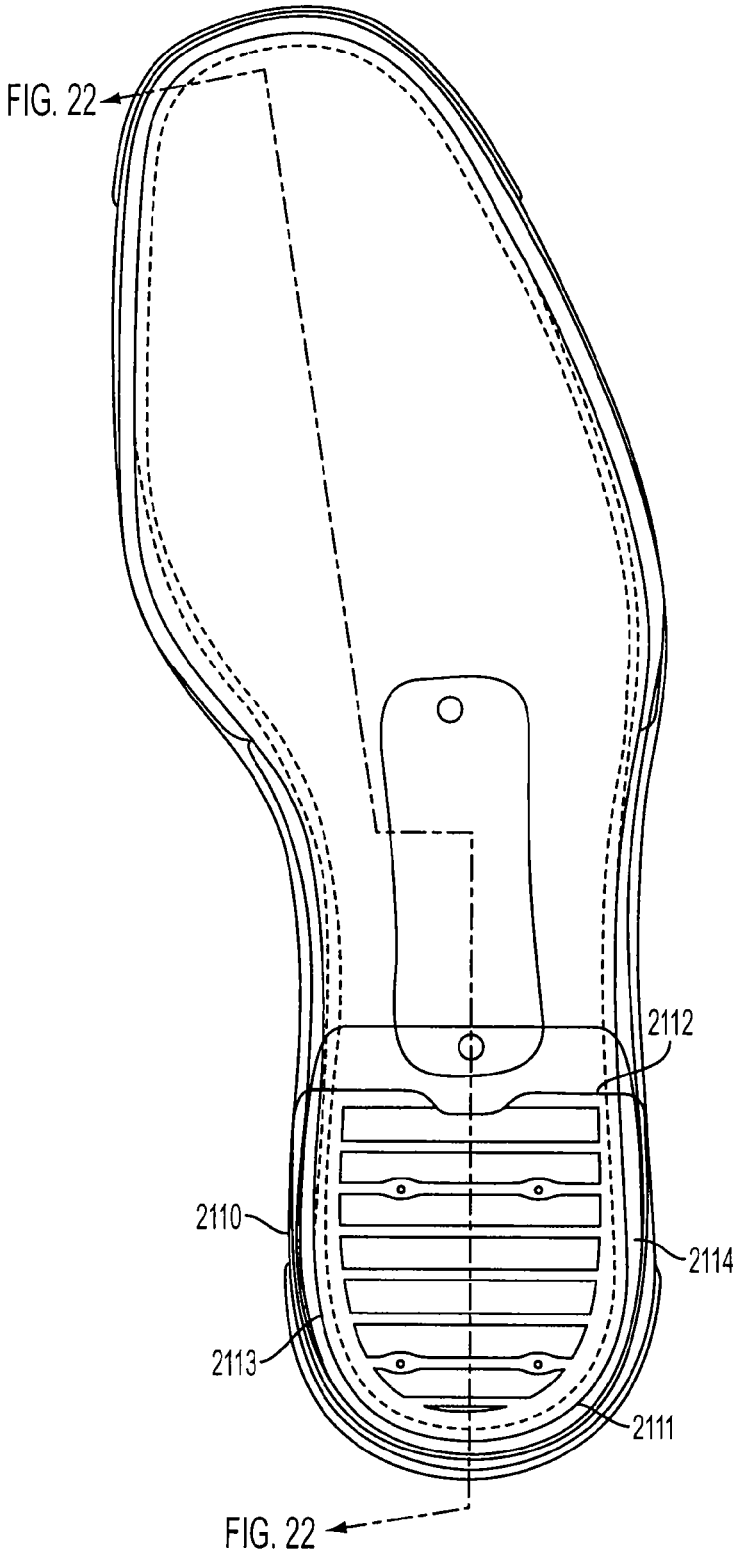
FIG. 21 is a top view of a shoe having a cushioning member according to a third embodiment of the present invention disposed therein.
Figure 22:
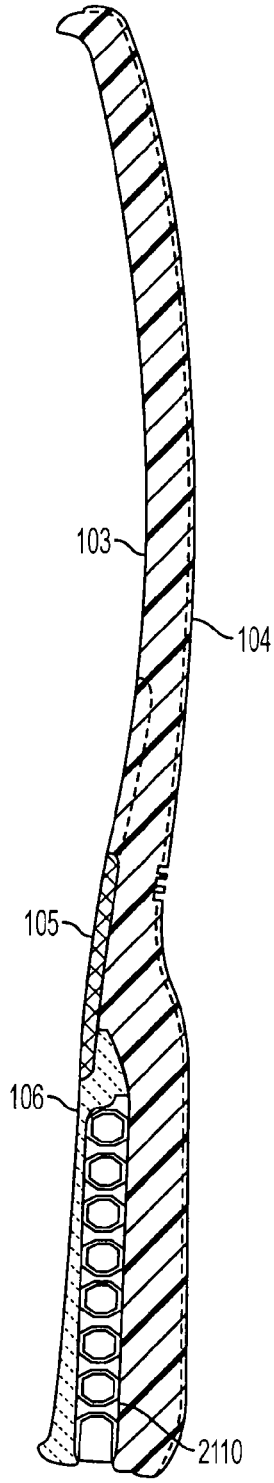
FIG. 22 is a cross-sectional view of a shoe having a cushioning member according to a third embodiment of the present invention, taken along line 22-22 of FIG. 21.
Figure 23:
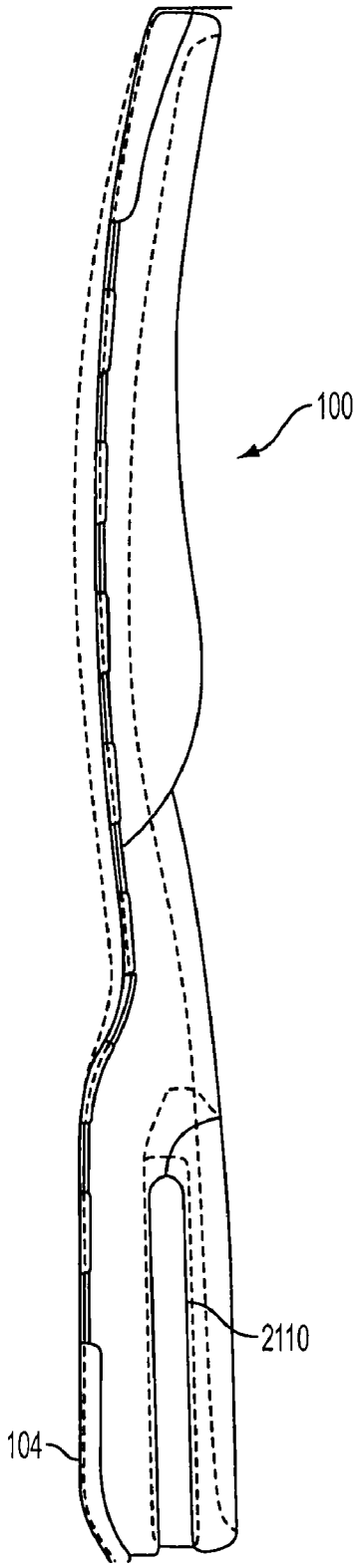
FIG. 23 is a side view of a shoe having a cushioning member according to a third embodiment of the present invention

A third embodiment of the cushioning member 200 of the present invention is shown in FIGS. 21-23, in which like reference numerals refer to like elements. The cushioning member 200 shown includes only a heel chamber 2110. The heel chamber 2110 is disposed beneath the heel of a wearer when the cushioning member 200 is incorporated within the shoe 100. The heel chamber 2110 includes a curved posterior wall 2111, and an anterior wall 2112. A medial sidewall 2113, and a lateral sidewall 2114 are disposed between the posterior wall 2111 and the anterior wall 2112. The posterior wall 2111, the medial sidewall 2113, and the lateral sidewall 2114 are provided such that the heel chamber 2110 may generally comprise a symmetrical u-shaped chamber that conforms to the outline of the heel portion of the sole 102. The cushioning member 200 shown may provide cushioning from the impact forces received at the heel portion of the foot.

In one embodiment, as shown in FIG. 22, a heel section 106 of the midsole 103 comprising a material different from the rest of the midsole 103, such as, for example, polyurethane, may first be molded directly to the cushioning member 200. The heel section 106 and the cushioning member 200 may then be cemented into a cavity formed in the midsole 103. It is contemplated that other embodiments of the present invention may be provided without the heel section 106 and the midsole 103 may be formed around the cushioning member 200.

With reference to FIG. 23, the sole 102 may be formed around the cushioning member 200 such that at least a portion of the heel chamber 2110 of the cushioning member 200 is visible. In one embodiment, at least a portion of the medial heel sidewall 2113 and at least a portion of the lateral heel sidewall 2114 may be visible. In other embodiments of the present invention, all of or a portion of one or more of the medial heel sidewall 2113, the lateral heel sidewall 2114, and the posterior wall 2111 may be visible.

The manner of inflating the cushioning member 200 of various embodiments of the present invention will now briefly be described. In embodiments of the present invention in which the cushioning member 200 is filled with pressurized gas, the cushioning member 200 may be filled with gas at a pressure that provides a suitable level of cushioning and fluid flow. As will be apparent to those of ordinary skill in the art, a tube (not shown) may be formed in the cushioning member for receiving an air hose. The air hose may be attached to the tube and the cushioning member may be pressurized to a predetermined level. When the desired pressure is reached, the tube may be heat sealed to prevent leakage from the cushioning member.

At higher pressures, there is generally more fluid filling the cushioning member, and the cushioning member experiences less compression during operation. As a result, a cushioning member filled at too high a pressure may create a hard and uncomfortable feeling underneath the foot of the wearer. At lower pressures, there may be increased fluid flow within the cushioning member, and increased "pistoning" of the wearer's foot inside the shoe. As a result, a cushioning member filled at too low a pressure may provide less cushioning, and the resulting increased movement of the foot may lead to blistering. In addition, too much flow of fluid may create a sensation beneath the foot of the wearer that can cause discomfort. Thus, it is important that the proper balance of fluid pressure within the cushioning member 200 be reached.

Each of the embodiments of the present invention may be pressurized to different pressure ranges such that the cushioning members provide preferred levels of cushioning and fluid flow. For example, the first embodiment of the cushioning member 200 shown in FIGS. 2-12 may be pressurized to a level in the range of from about 1 psi to about 4 psi. In a preferred embodiment, the first embodiment of cushioning member 200 is pressurized to about 2 psi. The second embodiment of cushioning member 200 shown in FIGS. 13-20 may be pressurized to a level in the range of from about 1 psi to about 7 psi. The third embodiment of the cushioning member 200 shown in FIGS. 21-23 may be pressurized to a level in the range of from about 4 psi to about 7 psi. In a preferred embodiment, the third embodiment of the cushioning member 200 is pressurized to a range of from about 5 psi to about 6 psi. The above pressure ranges are for a cushioning member 200 in an unloaded condition. It is appreciated that the pressure within the cushioning member 200 will change during operation.

While various embodiments of the present invention have been described above, it should be understood that they have been presented by way of example only, and not limitation. It will be apparent to persons skilled in the relevant art that various changes in form and detail can be made therein without departing from the spirit and scope of the present invention. Thus, the breadth and scope of the present invention should not be limited by any of the above-described exemplary embodiments, but should be defined only in accordance with the following claims and their equivalents. All patents and publications discussed herein are incorporated in their entirety by reference thereto.

What is claimed is:

1. An article of footwear, comprising:

a sole; and a cushioning member disposed in said sole, said cushioning member comprising:

a substantially symmetrical u-shaped heel chamber, said heel chamber having an anterior wall, a posterior wall, and medial and lateral sidewalls disposed between the anterior wall and the posterior wall;

a discrete forefoot chamber, wherein said forefoot chamber comprises an anterior wall, a posterior wall, and medial and lateral forefoot sidewalls disposed between the forefoot anterior wall and the forefoot posterior wall, and wherein said sole is formed around said cushioning member such that at least a portion of the medial forefoot sidewall and the lateral forefoot sidewall are visible, and wherein a first weld line is formed in said forefoot chamber along the medial forefoot sidewall and at least a portion of the first weld line is spaced from the medial forefoot sidewall and a second weld line is formed in said forefoot chamber along the lateral forefoot sidewall and at least a portion of the second weld line is spaced from the lateral forefoot sidewall; and a passage connecting said heel chamber and said forefoot chamber, wherein said sole is formed around said cushioning member such that at least a portion of the medial heel sidewall and the lateral heel sidewall are visible.

2. The article of footwear according to claim 1, wherein said sole is formed around said cushioning member such that at least a portion of the heel posterior wall is visible.

3. The article of footwear according to claim 1, wherein said sole is formed around said cushioning member such that the medial heel sidewall, the lateral heel sidewall, and the heel posterior wall are visible.

4. The article of footwear according to claim 1, wherein said passage comprises first and second fluid ports in communication with said forefoot chamber.

5. The article of footwear according to claim 4, further comprising a depression formed in said cushioning member between said first and second air ports.

6. The article of footwear according to claim 5, wherein said depression is adapted to be disposed beneath the metatarsal region of a wearer of the article of footwear.

7. The article of footwear according to claim 1, wherein said cushioning member is filled with a gas.

8. The article of footwear according to claim 7, wherein the gas is Nitrogen.

9. The article of footwear according to claim 7, wherein the pressure of the gas in said cushioning member is in the range of from about 1 psi to about 7 psi when said cushioning member is in an unloaded condition.

10. The article of footwear according to claim 7, wherein the pressure of the gas in said cushioning member is about 2 psi when said cushioning member is in an unloaded condition.

11. The article of footwear according to claim 1, wherein said cushioning member is filled with ambient air.

12. The article of footwear according to claim 1, wherein the thickness of said heel chamber is greater than the thickness of said forefoot chamber by a ratio of about 2 to 1.

13. The article of footwear according to claim 1, further comprising means for controlling the flow of fluid in said cushioning member, said means formed in said heel chamber.

14. The article of footwear according to claim 13, wherein said flow control means comprises at least one weld line.

15. The article of footwear according to claim 14, wherein said at least one weld line comprises a plurality of weld lines formed around the periphery of said heel chamber.

16. The article of footwear according to claim 13, wherein said flow control means comprises at least one dot weld formed in said forefoot chamber.

17. A cushioning member filled with a pressurized gas disposed in an article of footwear having a sole, the cushioning member comprising:

a heel chamber having an anterior wall, a curved posterior wall, and medial and lateral sidewalls disposed between the anterior wall and the posterior wall;

a forefoot chamber having an anterior wall, a posterior wall, and medial and lateral forefoot sidewalls disposed between the forefoot anterior wall and the forefoot posterior wall; and a passage connecting said heel chamber and said forefoot chamber, wherein the sole is formed around said cushioning member such that at least a portion of the medial heel sidewall and the lateral heel sidewall are visible and at least a portion of the forefoot chamber is visible and wherein a first weld line is formed in said forefoot chamber along the medial forefoot sidewall and at least a portion of the first weld line is spaced from the medial forefoot sidewall and a second weld line is formed in said forefoot chamber along the lateral forefoot sidewall and at least a portion of the second weld line is spaced from the lateral forefoot sidewall.

18. The cushioning member according to claim 17, wherein the pressure of the gas in the cushioning member is in the range of from about 1 psi to about 7 psi when the cushioning member is in an unloaded condition.

19. The cushioning member according to claim 17, wherein the thickness of said heel chamber is greater than the thickness of said forefoot chamber by a ratio of about 2 to 1.

20. A fluid-filled cushioning member disposed in an article of footwear having a sole, the cushioning member comprising:

a substantially symmetrical u-shaped heel chamber having an anterior wall, a posterior wall, and medial and lateral sidewalls disposed between the anterior wall and the posterior wall;

a forefoot chamber having an anterior wall, a posterior wall, and medial and lateral sidewalls disposed between the forefoot anterior wall and the forefoot posterior wall; and a passage connecting said heel chamber and said forefoot chamber, said passage comprising first and second air ports in communication with said forefoot chamber, and a depression formed between said first and second air ports, wherein the sole is formed around said cushioning member such that at least a portion of the heel chamber is visible and at least a portion of the forefoot chamber is visible, wherein the sole is formed around said cushioning member such that at least a portion of the medial and lateral heel sidewalls are visible and at least a portion of the medial and lateral forefoot sidewalls are visible, and wherein a first weld line is formed in said forefoot chamber along the medial forefoot sidewall and at least a portion of the first weld line is spaced from the medial forefoot sidewall and a second weld line is formed in said forefoot chamber along the lateral forefoot sidewall and at least a portion of the second weld line is spaced from the lateral forefoot sidewall.

21. The cushioning member according to claim 20, further comprising means for controlling the flow of fluid in the cushioning member, said means formed in said heel chamber.

22. The cushioning member according to claim 21, wherein said flow control means comprises a plurality of weld lines.

23. The cushioning member according to claim 22, wherein said plurality of weld lines is formed around the periphery of said heel chamber.

* * * * *